United States Patent [19]

Earle et al.

[11] 4,332,553

[45] Jun. 1, 1982

[54] VACUUM FIRING PORCELAIN FURNACE

[75] Inventors: Roger W. Earle; William J. Walsh, both of Dubuque, Iowa

[73] Assignee: Sybron Corporation, Rochester, N.Y.

[21] Appl. No.: 229,956

[22] Filed: Jan. 30, 1981

[51] Int. Cl.[3] ..... F27B 5/04; F27B 11/00

[52] U.S. Cl. ..... 432/205; 266/250; 432/206; 373/141

[58] Field of Search ..... 432/206, 208, 250, 241, 432/242, 205; 13/31 R; 266/253, 250

[56] References Cited

U.S. PATENT DOCUMENTS

| | | | |
|---|---|---|---|
| 2,266,735 | 12/1941 | Berghaus et al. | 13/31 |
| 2,354,127 | 7/1944 | Krauscope et al. | 432/250 |
| 3,128,326 | 4/1964 | Hintenberger | 13/31 |
| 3,403,212 | 9/1968 | Sato | 13/31 |
| 3,441,652 | 4/1969 | Eicker | 13/31 X |

*Primary Examiner*—John J. Camby

*Attorney, Agent, or Firm*—Theodore B. Roessel; Roger Aceto

[57] ABSTRACT

A furnace having an easily disassembled vacuum chamber to facilitate muffle replacement. The muffle is located over pins on the vacuum chamber base and is held against the base by a leaf spring between the muffle and the vacuum chamber top. The cylindrical wall of the vacuum chamber is correctly located with respect to the muffle by upright spacer bars upstanding from the vacuum chamber base about the periphery of the cylindrical wall. The spacer bars further serve to tie the top and base of the vacuum chamber together and against the cylindrical wall. The furnace is bottom loaded and has a door seal carried by the base so that the seal is not exposed to the direct heat from the muffle when the door is opened.

11 Claims, 3 Drawing Figures

VACUUM FIRING PORCELAIN FURNACE

BACKGROUND OF THE INVENTION

The present invention relates to a kiln, furnace or the like and more particularly to such a furnace as may be suitable for use by dental laboratories in the firing of dental porcelain or crowns, bridges and the like.

It is desirable to fire dental porcelain in a subatmospheric environment. Accordingly, dental porcelain firing furnaces, as are known in the art, have a muffle housed within a chamber that can be evacuated. Since this chamber must be air tight, the replacement of burned out muffles is usually a tedious process resulting in considerable down time of the furnace.

It is also known in the art to have such furnaces bottom loaded. In this way, the raw crown or bridge work can be gradually raised into the furnace muffle so that the heat of the furnace will dry and preheat the workpiece prior to firing. Bottom loading has proved to be more heat efficient under these circumstances in that less heat escapes the muffle than from a front loading door.

A bottom loading furnace permits a more uniform distribution of heat about the work piece whereas a front loading furnace for example, may have a cold spot at the front. However, there must be a means to seal the bottom loading door against the muffle in order to draw a vacuum within the chamber. In the prior art, this has been accomplished by an O-ring attached to the door. Such O-rings have had a short life in that with the door partly open, and in a position to dry the restoration prior to firing, the seal on the door is directly exposed to the heat of the furnace.

In contrast to the prior art, the vacuum firing porcelain furnace of the present invention is easily assembled or disassembled thereby greatly facilitating muffle replacement. The present invention also relocates the seal means for the door of the furnace which increases seal life.

DESCRIPTION OF THE PREFERRED EMBODIMENTS

Figure 1:
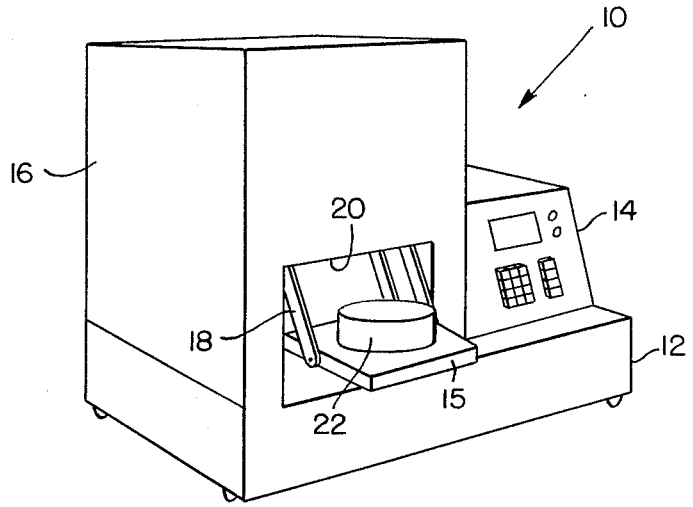
FIG. 1 is a perspective view showing the furnace with the bottom loading door in an open position.

Referring to the drawings, FIG. 1 shows the vacuum firing porcelain furnace generally indicated at 10. The furnace includes the base portion 12 which supports a control console 14 and a furnace portion 16. Various electrical and vacuum line connections are at the back of the unit and are not shown.

Preferably, the furnace is bottom loading. In this respect, the furnace door, while not identical to, is similar in many respects to the door arrangement shown for example in U.S. Pat. No. 4,074,963. It is sufficient for purposes of the present invention to say that the door 15 is supported on a parallel motion linkage indicated at 18 and that when the door is opening, it swings down and forward through an opening 20 at the front of furnace portion 16. The door carries a hearth plate 22 on which the bridge or crown to be fired is placed. When closing, the door swings inward through opening 20 and upward into the furnace as will be described hereinbelow.

Figure 2:
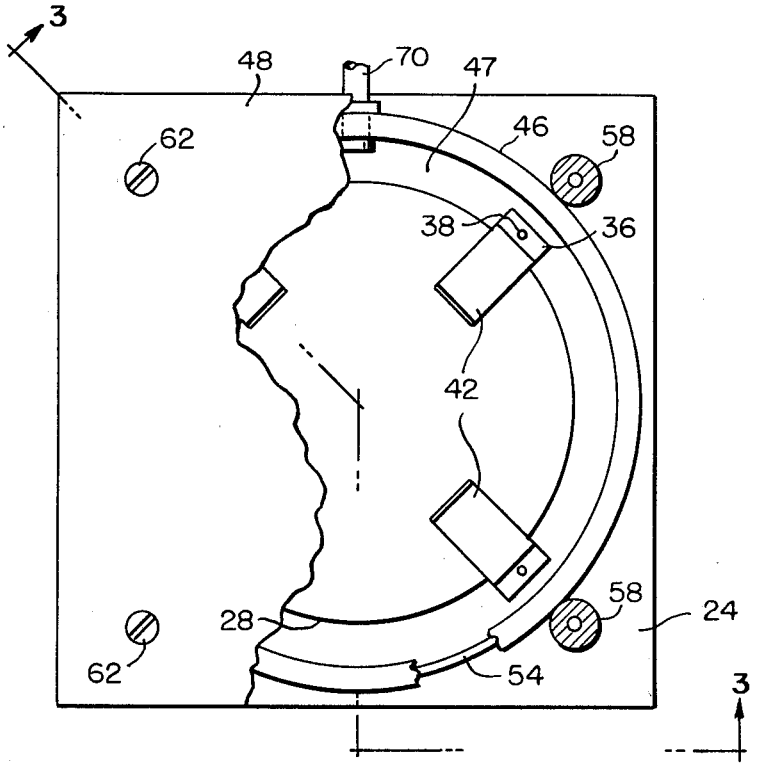
FIG. 2 is a plan view partly broken away and in section showing the muffle portion of the furnace.
Figure 3:
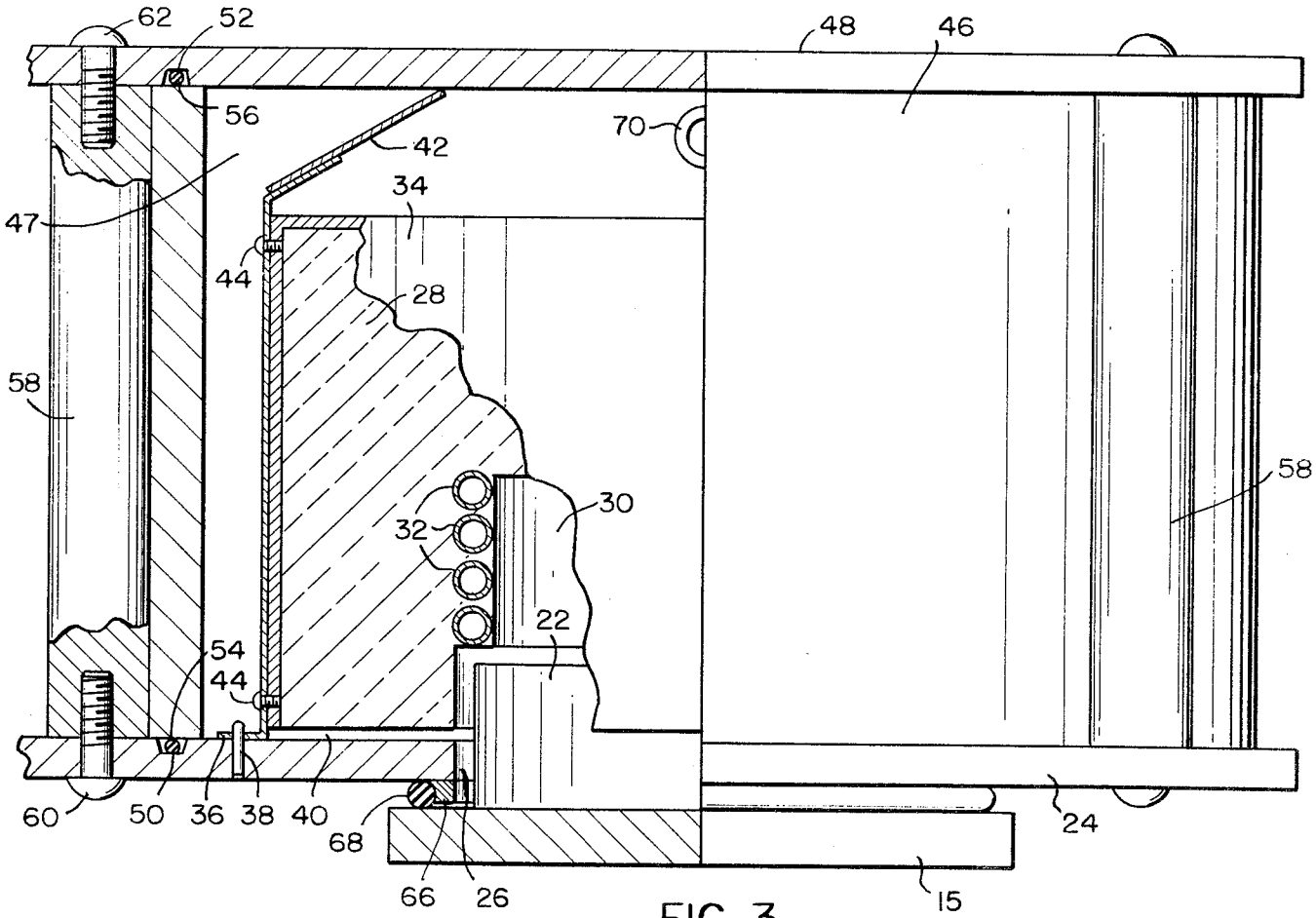
FIG. 3 is a view taken along lines 3—3 of FIG. 2 but on a larger scale.

Referring to FIG. 3, only the furnace portion 16 of the unit shown in FIG. 1 is shown as it is this part which has the claimed invention. It should also be appreciated that in FIGS. 2 and 3 the outer sheet metal decorative skin as shown, for example, in FIG. 1 has been omitted for clarity.

As shown in FIG. 3, the furnace portion includes a base plate 24 having an opening 26 through which objects are loaded into the furnace. Carried by base plate 24 is a generally conventional muffle 28 which encloses a firing chamber 30. This firing chamber is open at its bottom for communication with base plate opening 26. The muffle may be made of any suitable material such as fire brick or any of the filter molded heat insulating materials as is well known in the art. The incorporation of heating means in the muffle is also well known in the art and such heating means is represented in the FIGURE by electric resistance heating coils 32 which are disposed about the firing chamber 30.

The muffle 28 at its top and sides, is enclosed within a thin sheet metal skin 34. Attached about the lower periphery of the sheet metal skin are a plurality, preferably four, L-shaped brackets 36. Each bracket is provided with an opening adapted to receive a muffle locating pin 38 which is fixed to and upstands from base plate 24. Moreover, brackets 36 extend slightly below the bottom edge of the muffle so that a small gap 40 exists between base plate 24 and the bottom of muffle 28.

Extending from about the upper periphery of the sheet metal skin, are a plurality, again, preferably four, leaf springs 42. These springs, as will be described hereinbelow, are biased against the upper surface of the vacuum chamber for holding the muffle against base plate 24. In any event, as best shown in FIG. 3, construction may be facilitated by spot welding the leaf springs 42 to the ends of brackets 36 and then attaching the brackets to the side of the metal skin 34 by any suitable means such as screws 44.

Surrounding the muffle 28 is the cylindrical, metal wall 46 of a vacuum chamber 47. The bottom of the vacuum chamber is formed by base plate 24 while the top is formed by a top plate 48 which is similar to the base plate 24 except that there is no central opening. Both base plate 24 and the top plate 48 are provided with grooves 50, 52 respectively which are concentric with the lower and upper ends of cylindrical wall 46 (FIG. 3). O-rings 54, 56 located in each of these grooves act to provide an air tight seal between the ends of the cylindrical wall 46 and the bottom and top plates 24, 48 respectively.

As best seen in FIGS. 2 and 3, base plate 24 and top plate 48 extend beyond the outer periphery of cylindrical wall 46. This is done to accommodate upright spacer bars 58 which serve to connect the top plate 48, cylindrical wall 46 and base plate 24 together. This is accomplished by simply attaching the spacer bars to the base plate by any suitable means such as screws 60. The top plate 48 is then placed on the spacer bars and attached to the other end of the spacer bar by screws 62. The spacer bars 58 are each essentially the same length as cylindrical wall 46 so that the top and base plates can be snugged against the O-rings 54, 56 to form a seal about the upper and lower ends of the cylindrical wall. Moreover, when the top 48 is attached, it bears against springs 42 to hold the muffle in position over locating pins 38. The spacer bars also serve to locate and position cylindrical wall 46 in a correct position with respect to O-rings 54, 56.

In order to be able to draw a vacuum within the vacuum chamber 47 as defined by cylindrical wall 46, base plate 24 and top plate 48, the door 15 which closes the opening 26 must seal against base plate 24. This is accomplished by fixing an annular ring 66 to the bottom surface of the base plate about opening 26. The outer periphery of this ring is slightly concave to accept an O-ring 68. The nominal diameter of O-ring 68 is slightly greater than the thickness of ring 66 so that a portion of the O-ring is exposed and extends below the level of the ring. Accordingly, as door 15 is closed, the upper surface of the door bears against this O-ring 68 to provide an airtight seal.

Completing the structure as shown in FIGS. 2 and 3 is a connection 70 for a vacuum line which extends through cylindrical wall 46.

In operation, the porcelain article to be fired is placed on the hearth plate 22 when the door 15 is in the open position as shown in FIG. 1. Apparatus (not shown) is then operated to partly close the door so that the object is below or only partly in the firing chamber 30. From this position, the porcelain article is dried and preheated by gradually closing the door in a series of incremental steps. Time between steps can be varied according to a preselected program set on the control console 14 so that the operator can specify the overall closing time. Thereafter, the door is fully closed so that it seals against O-ring 68 and locates the article to be fired fully within the firing chamber.

Thereafter, the vacuum pump (not shown) may be operated to evacuate the air from within the vacuum chamber 47. Since brackets 36 support muffle 28 slightly above base plate 24, any air within the firing chamber 30 is drawn through the gap 40 so that a subatmospheric pressure also is created within the firing chamber 30. As the negative pressure is drawn, atmospheric pressure exerted on the base and top plates 24, 48 enhance the sealing against O-rings 54 and 56 to maintain the pressure tight environment within vacuum chamber 47 during the firing sequence.

Thus, it will be appreciated that the present invention provides a vacuum firing porcelain furnace having several unique characteristics. For example, by locating an O-ring 68 at the bottom of base plate 24 and about the exterior periphery of annular ring 66, the O-ring is not directly exposed to the heat of the firing chamber 30 when the door 15 is opened or closed. This provides for a longer O-ring life.

Also, should the heating element 32 burn out, or be damaged, replacement of the muffle 28 can be accomplished quickly and easily simply by removing the top plate 48, lifting old muffle out of cylinder 46, and then inserting a new muffle so as to locate the brackets 36 over the locating pins 38. Replacement of the top plate 48 then draws all the parts together as described hereinabove. This muffle replacement can be accomplished in the matter of a few minutes.

It should be appreciated that there are various temperatures sensors and other controls attached to the top surface of the muffle but these have not been shown as they play no part of the invention. Such connections would not materially interfere with the replacement of the muffle.

Having thus described the invention in detail, what is claimed as new is:

1. A vacuum firing porcelain furnace including a vacuum chamber and means for evacuating the chamber, said furnace comprising:

(a) a top plate, base plate and an upright side wall defining said vacuum chamber, said base plate having an opening therethrough;

(b) a muffle in said vacuum chamber, said muffle enclosing a firing chamber which communicates with said opening;

(c) locating means on said muffle and cooperating with said top and bottom plates for locating and holding said muffle in a preselected position against said base plate said locating means including (i) an L-shaped bracket having a first leg fixed to the periphery of said muffle and a second leg extending outward from said muffle, said second leg having an opening therethrough, and (ii) a locating pin on said base plate adapted to be received in said bracket opening for locating said muffle at a preselected position within said vacuum chamber;

(d) seal means carried by said base plate about the lower periphery of said opening, and (e) a door supported by said furnace for movement upward against said seal means to close said opening.

2. A furnace as in claim 1 wherein said first leg extends downward from the periphery of said muffle for supporting said muffle above said base plate, said base plate and muffle defining a space therebetween which provides communication between said vacuum chamber and said firing chamber.

3. A vacuum firing porcelain furnace including a vacuum chamber and means for evacuating the chamber, said furnace comprising:

(a) a top plate, base plate and an upright side wall defining said vacuum chamber, said base plate having an opening therethrough;

(b) a muffle in said vacuum chamber, said muffle enclosing a firing chamber which communicates with said opening;

(c) locating means on said muffle and cooperating with said top and bottom plates for locating and holding said muffle in a preselected position against said base plate said locating means including a leaf spring biased between said top plate and said muffle for urging said muffle towards said base plate;

(d) seal means carried by said base plate about the lower periphery of said opening; and (e) a door supported by said furnace for movement upward against said seal means to close said opening.

4. A furnace as in claim 3 wherein said leaf spring is fixed to the upper portion of a member which is fixed to and extends downwardly along the periphery of said muffle, the lower end of said member terminating in an L-shaped bracket for supporting said muffle on said base plate.

5. A furnace as in claim 4 including a pin upstanding from said base plate; and said bracket having an opening therein for receiving said pin to locate said muffle at a predetermined position on said base plate.

6. A vacuum firing porcelain furnace including a vacuum chamber and means for evacuating the chamber, said furnace comprising:

(a) a top plate, base plate and an upright side wall defining said vacuum chamber, said base plate having an opening therethrough;

(b) a muffle in said vacuum chamber, said muffle enclosing a firing chamber which communicates with said opening;

(c) locating means on said muffle and cooperating with said top and bottom plates for locating and holding said muffle in a preselected position against said base plate;

(d) an annular member fixed to the bottom of said base plate about said opening, the exterior periphery of said annular member defining a seal seat;

(e) a seal in said seat; and (f) a door supported by said furnace for movement upward against said seal to a closed position, said seal being adapted to engage against said door when said door is in said closed position.

7. A furnace as in claim 6 wherein the exterior periphery of said annular member is concave and said seal is an O-ring, the nominal diameter of said O-ring being slightly greater than the height of said annular member.

8. In a furnace including a vacuum chamber, means to evacuate the vacuum chamber, a muffle within the vacuum chamber, means for loading articles into the muffle through the bottom of the vacuum chamber, and a door for the opening, the improvement comprising:

(a) said vacuum chamber having a cylindrical wall, a base with an opening therethrough and a top;

(b) O-ring seals between the top and bottom edges of said cylindrical wall and said top and base respectively;

(c) spacer bars upstanding from said base about the periphery of said cylindrical wall for locating said cylindrical wall at a predetermined position on said base; and (d) means fixing said top to the upper ends of said spacer bars to permit snug engagement of said top and base to the top and bottom edges of said cylindrical wall.

9. A furnace as in claim 8 including bias means between said top and said muffle for urging said muffle against said base.

10. A furnace as in claim 8 or 9 including cooperating means on said muffle and base for locating said muffle at a preselected position on said base.

11. A furnace as in claims 8 or 9 including an annular member on the lower surface of said base about said opening, the outer peripheral surface of said member being concave; and an O-ring seal seated in said concave surface and engaging against said door when said door is in the closed position.

* * * * *